US006105694A

United States Patent [19]

Scott

[11] Patent Number: 6,105,694

[45] Date of Patent: Aug. 22, 2000

[54] DIAMOND ENHANCED INSERT FOR ROLLING CUTTER BIT

[75] Inventor: Danny Eugene Scott, Montgomery, Tex.

[73] Assignee: Baker Hughes Incorporated, Houston, Tex.

[21] Appl. No.: 09/106,981

[22] Filed: Jun. 29, 1998

[51] Int. Cl.[7] ..... E21B 10/46

[52] U.S. Cl. ..... 175/428; 175/374

[58] Field of Search ..... 175/426, 428, 175/432, 374

[56] References Cited

U.S. PATENT DOCUMENTS

| | | | |
|---|---|---|---|
| 4,811,801 | 3/1989 | Salesky et al. . | |
| 4,858,707 | 8/1989 | Jones et al. | 175/329 |
| 5,158,148 | 10/1992 | Keshavan . | |
| 5,282,512 | 2/1994 | Besson et al. . | |
| 5,335,738 | 8/1994 | Waldenstrom et al. | 175/420.2 |
| 5,337,844 | 8/1994 | Tibbitts | 175/434 |
| 5,370,195 | 12/1994 | Keshavan et al. . | |
| 5,469,927 | 11/1995 | Griffin . | |
| 5,706,906 | 1/1998 | Jurewicz et al. | 175/428 |
| 5,746,280 | 5/1998 | Scott et al. | 175/374 |

*Primary Examiner*—William Neuder
*Assistant Examiner*—Zakiya Walker
*Attorney, Agent, or Firm*—James E. Bradley

[57] ABSTRACT

An earth-boring bit has a bit body and a cantilevered bearing shaft depending from the bit body. The cutter is mounted for rotation on the bearing shaft. Cutting elements are secured within holes formed in the cutter. At least some of the cutting elements include a body of hard metal which has a cylindrical base inserted in an interference fit within one of the holes. The body has a contact surface on its cutting end. A layer of super-hard material is bonded to the contact surface to provide a tip for the cutting end. The layer may be formed of a free-standing film of diamond which is brazed to the contact surface. It may also be formed with a high temperature, high pressure process directly onto the body of tungsten carbide.

20 Claims, 3 Drawing Sheets

DIAMOND ENHANCED INSERT FOR ROLLING CUTTER BIT

TECHNICAL FIELD

This invention relates to improvements in the cutting structure of earth-boring bits, particularly bits having cutting elements which have super-hard or diamond layers thereon.

BACKGROUND ART

In drilling boreholes in earthen formations by the rotary method, rock bits fitted with one, two, or three rolling cutters may be employed. The bit is secured to the lower end of a drill string that is rotated from the surface or by downhole motors or turbines. The cutters mounted on the bit roll and slide upon the bottom of the borehole as the drill string is rotated, thereby engaging and disintegrating the formation material to be removed. The roller cutters are provided with teeth or cutting elements that are forced to penetrate and gouge the bottom of the borehole by weight from the drill string. The cuttings from the bottom and sidewalls of the borehole are washed away by drilling fluid that is pumped down from the surface through the hollow, rotating drill string and are carried in suspension in the drilling fluid to the surface.

It has been a conventional practice for several years to provide diamond or super-hard cutting elements or inserts in earth-boring bits known as PDC, or fixed cutter bits. The excellent hardness, wear, and heat dissipation characteristics of diamond and other super-hard materials are of particular benefit in fixed cutter or drag bits, in which the primary cutting mechanism is scraping. Diamond cutting elements in fixed cutter or drag bits commonly comprise a disk or table of natural or polycrystalline diamond integrally formed on a cemented tungsten carbide or similar hard metal substrate in the form of a stud or cylindrical body that is subsequently brazed or mechanically fit on a bit body.

Implementation of diamond cutting elements as primary cutting structure in earth-boring bits of the rolling cutter variety has been less common than with earth-boring bits of the fixed cutter variety. One reason is that the primary cutting elements of rolling cutter bits are subjected to more complex loadings, depending on their location on the cutters, making separation of the diamond tables from their substrates more likely. Moreover, because the loads encountered by the cutting elements of rolling cutter bits are typically much larger in magnitude than the loads sustained by the cutting elements of fixed cutter bits, stress concentrations caused by prior-art land and groove arrangements at the interface between the diamond and its substrate, such as shown by U.S. Pat. No. 5,379,854 to Dennis, can cause the diamond to crack or fracture.

One solution is found in U.S. Pat. Nos. 4,525,178; 4,504106; and 4,694,918 to Hall, which disclose cutting elements for a rolling cutter bit having the diamond and substrate formed integrally with a transition layer of a composite of diamond and carbide between the diamond layer and carbide layer. This transition layer is purported to reduce residual stresses between the diamond and carbide because the composite material reduces the differences in mechanical and thermal properties between the diamond and carbide materials. Another solution, disclosed in commonly assigned U.S. Pat. No. 5,119,714 to Scott, is to form a hard metal jacket around a diamond core. Unfortunately, these can be more difficult to manufacture than conventional flat PDC parts and are subject to costly and complex finishing operations.

A need exists, therefore, for diamond cutting elements or inserts for earth-boring bits of the rolling cutter variety that are sufficiently durable to withstand the rugged downhole environment and that are economical to manufacture.

DISCLOSURE OF INVENTION

In this invention, at least some of the cutting elements have a body of hard metal. The body has a cylindrical base which is inserted in an interference fit in one of the holes in the cutter support. The body has a circular contact surface on an end which is opposite and generally parallel to the bottom. A convex layer of super-hard material is attached to the contact surface.

In one embodiment, the body has side surfaces which are truncated to form a contact surface which is substantially parallel with the bottom. Preferably the side surfaces are conical and the layer of super-hard material is also conical, forming an apex for the side surfaces. In another embodiment, the layer of super-hard material is an ovoid which is bonded to a contact surface of the insert body. The ovoid layer may be centered axially or it may be offset.

The super-hard layer is preferably of diamond. In one embodiment, the diamond is a free-standing layer of diamond film formed by chemical vapor deposition that is brazed to the contact surface. In another embodiment, the layer comprises polycrystalline diamond formed on the contact surface by high pressure and high temperature.

BEST MODE FOR CARRYING OUT THE INVENTION

Figure 1:
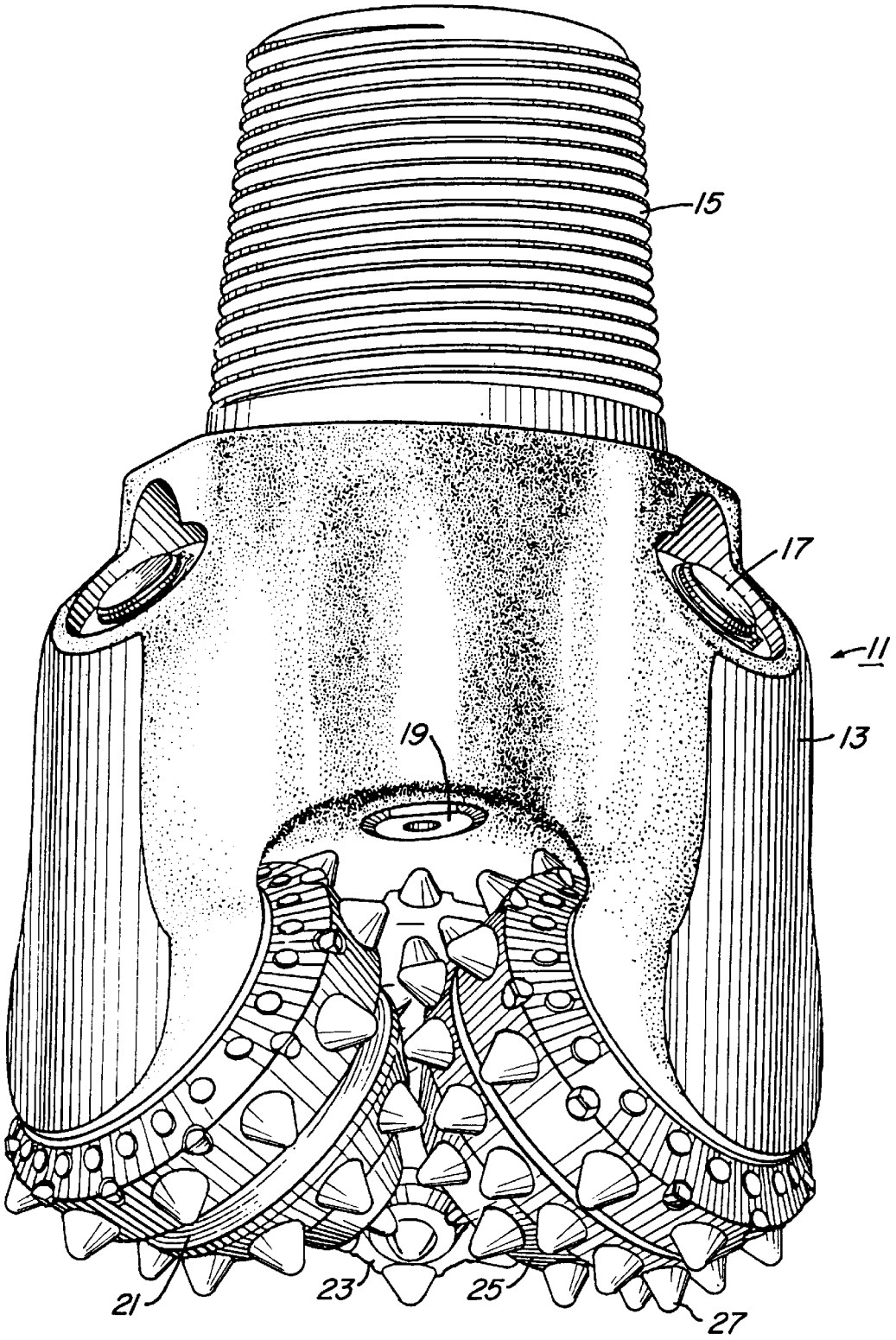
FIG. 1 is a perspective view of an earth-boring bit of the rolling cutter variety according to the present invention.

Referring to FIG. 1, an earth-boring bit 11 according to the present invention is illustrated. Bit 11 includes a bit body 13 which is threaded at its upper extent 15 for connection into a drill string. Each leg or section of bit 11 is provided with a lubricant compensator 17. At least one nozzle 19 is provided in bit body 13 to spray drilling fluid from within the drill string to cool and lubricate bit 11 during drilling operation. Three cutters 21, 23, 25 are rotatably secured to a bearing shaft associated with each leg of bit body 13.

Figure 2:
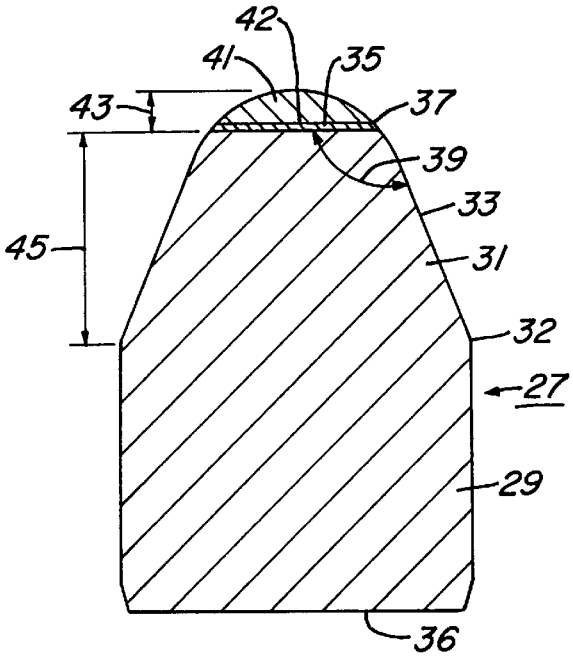
FIG. 2 is a sectional view of one of the cutting elements of the bit of FIG. 1, the sectional view taken along the line 2—2 of FIG. 3.
Figure 3:
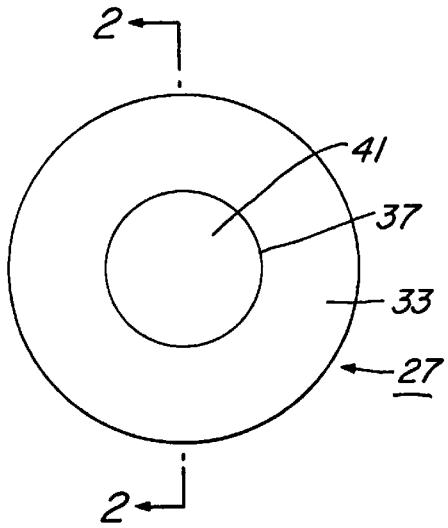
FIG. 3 is an end view of the cutting element of FIG. 2.

A plurality of cutting elements or inserts 27 are pressed in an interference fit into mating holes in each cutter 21, 23, 25. At least some of the inserts are constructed as shown in FIGS. 2 and 3. Cutting element 27 has a cylindrical base 29 which is inserted into one of the holes in one of the cutters 21, 23, 25. A cutting end 31 protrudes from base 29, forming a junction 32 with base 29. Cutting end 31 has side surfaces 33 which are preferably conical as shown in FIGS. 2 and 3.

Side surfaces 33 converge from junction 32 and terminate or are truncated to define a contact surface 35. In the embodiment of FIG. 2, contact surface 35 is generally parallel to the bottom surface 36 of base 29 and perpendicular to an axis of base 29. Contact surface 35 has a circular perimeter or border 37 in this embodiment. Contact surface 35 and conical side surfaces 33 form an obtuse angle 39. Base 29 and cutting end 31 are formed of a hard metal, preferably sintered tungsten carbide.

A tip 41 is attached to contact surface 35, forming an apex for the conical side surfaces 33. Tip 41 is a layer of a super-hard material. Tip 41 has a flat end which joins contact surface 35 and a convex end which is conical. Tip 41 has a greater thickness along the longitudinal axis of cutting element 27 than at its periphery. The periphery of tip 41 is circular and feathered or tapered at border 37. The periphery of tip 41 at border 37 is flush with the conical side surfaces 33, forming a smooth contour. In FIGS. 2 and 3, the thickness or axial extent 43 of tip 41 at its apex is much smaller than the axial extent 45 from junction 32 to contact surface 35. In the instance of FIG. 2, axial extent 43 is about 15% that of axial extent 45.

Tip 41 may be formed in two different manners. In one manner, tip 41 is formed from a free-standing layer of diamond film. The diamond film is joined to contact surface 35 by soldering or brazing, using an alloy layer 42. Free-standing layers of diamond film are commercially available from a number of sources including Diamonex Diamond Coatings of Allentown, Pennsylvania; Norton Company's Diamond Film Division, Northboro, Massachusetts; and DeBeers Industrial Diamond Division, Ascot, United Kingdom. Although the diamond films of the invention may be formed in various ways, the preferred manufacturing technique involves forming the diamond layers by chemical vapor deposition (CVD) techniques.

Various procedures have been developed to form diamond films by chemical vapor deposition and are generally well known. Such methods generally involve provided a mixture of a hydrocarbon gas, such as methane, and hydrogen gas that are activated at high temperatures in a controlled environment and directing them onto a substrate. Temperatures may range as low as 700–900° C. to well over 2000° C. Because of the high temperatures encountered in CVD, the substrate must have a high melting point above that required during the deposition process. The activated gases react to form elemental carbon, which is condensed as a polycrystalline diamond film upon the substrate. The deposition is carried out until the desired thickness of the film has been achieved on the substrate.

Once the diamond film is formed on the substrate, it can then be removed by physical or chemical methods. Physical release of the film from the substrate is usually accomplished by selecting a substrate having a different coefficient of thermal expansion than the diamond film. Cooling of the substrate thus causes the film to be released from the substrate. Alternatively, the substrate may be formed of materials that can be dissolved or etched away in an appropriate chemical compound. This may be preferable when the diamond films are formed on more intricate and complex-shaped substrates where release of the film by physical methods would be difficult or impossible.

The diamond film layer forming tip 41 may vary in thickness. The diamond layer can be formed into a variety of shapes and with different surface configurations or textures. In this embodiment, the substrate will have a conical concave deposition surface inverse to the convex conical end of tip 41.

Once the diamond film is removed from the deposition substrate, it can then be applied to contact surface 35 by brazing or soldering. Brazing technology has been developed to allow brazing of these films directly to a substrate with a shear strength exceeding 50,000 psi. A brazing alloy 42 is chosen to wet both diamond layer 41 and contact surface 35. Suitable metals that have been used as brazing alloys include titanium, tantalum, zirconium, niobium, chromium and nickel. The brazing alloy must also have a melting temperature lower than the melting temperature of the material of body 13. Brazing alloy 42 is positioned between contact surface 35 and diamond layer 41 and the materials are heated sufficiently until brazing alloy 42 is melted and a joint forms between diamond layer 41 and body 13. Temperatures required for brazing are typically between 750–1200° C. The brazing is usually carried out in a high vacuum, preferably greater than $1\times10^5$ Torr, or an oxygen-free inert gas environment to prevent carbon near the surface of the diamond from reacting with oxygen in the atmosphere to form carbon dioxide. The formation of carbon dioxide can prevent brazing alloy 42 from adhering to diamond layer 41 and compromises the integrity of the bond between the layer 41 and contact surface 35. The "DLA 2500" diamond brazing unit is commercially available from G. Paffenhoff GmbH of Remsheid, Germany, and can be used to braze diamond layer 41 to contact surface 35 in an inert gas atmosphere.

In another technique, tip 41 is formed on contact surface 35 by a high temperature, high pressure process. In that instance, contact surface 35 preferably has grooves or recesses formed therein to enhance adherence of the diamond. The HTHP process employs super-hard material such as natural diamond, polycrystalline diamond, cubic boron nitride and other similar materials approaching diamond in hardness and having hardnesses upward of about 3500–5000 on the Knoop harness scale. The super-hard layer 41 is formed using processes such as those disclosed in U.S. Pat. Nos 3,745,623 and 3,913,280.

Figure 4:
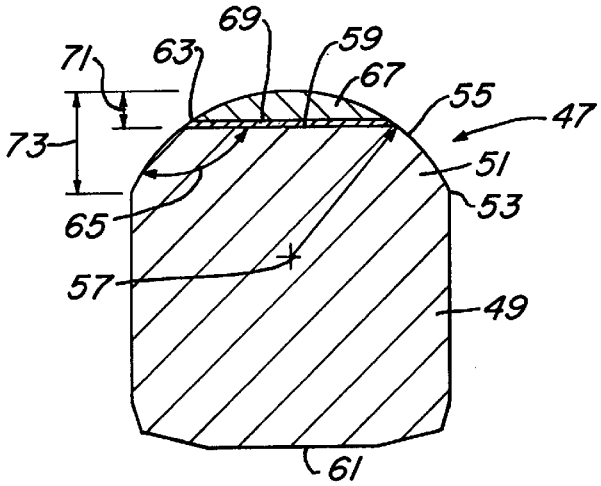
FIG. 4 is a sectional view of an alternate embodiment of an insert constructed in accordance with this invention, taken along the line 4—4 of FIG. 5.
Figure 5:
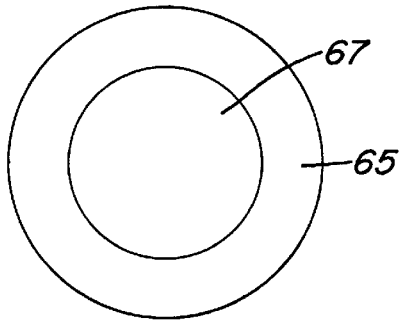
FIG. 5 is an end view of the cutting element of FIG. 4.

In the embodiment of FIGS. 4 and 5, cutting element 47 also has a cylindrical base 49 which is approximately the depth of the hole in one of the cutters 21, 23, 25 in which cutting element 47 will be inserted. A cutting end 51 protrudes from base 49, forming a junction 53 with base 49. Cutting end 51 has side surfaces 55 which are preferably shaped as a lower part of an ovoid, being curved on a radius 57 located between bottom 61 and junction 53.

Side surfaces 55 are truncated to define a contact surface 59. In the embodiment of FIG. 4, contact surface 59 is generally parallel to the bottom surface 61 of base 49 and perpendicular to an axis of base 49. Contact surface 59 has a circular perimeter or border 63. Contact surface 59 and side surfaces 55 are at an obtuse angle 65 relative to one another. Base 49 and cutting end 51 are formed of a hard metal, preferably sintered tungsten carbide.

A tip 67 is attached to contact surface 59, forming an apex for the ovoid side surfaces 55. Tip 67 is a layer of a super-hard material. Tip 67 has a flat end which joins contact surface 59 and a convex end which is an upper portion of an ovoid. Tip 67 has a greater thickness along the longitudinal axis of cutting element 47 than at its periphery. The periphery of tip 67 is circular and feathered or tapered at border 63. The periphery of tip 67 at border 63 is flush with the ovoid side surfaces 55, forming a smooth contour. The thickness or axial extent 71 of tip 67 at its apex is much smaller than the axial extent 73 from junction 53 to contact surface 59. Tip 67 may be formed in two different ways in the same manner as described in connection with the first embodiment.

Figure 6:
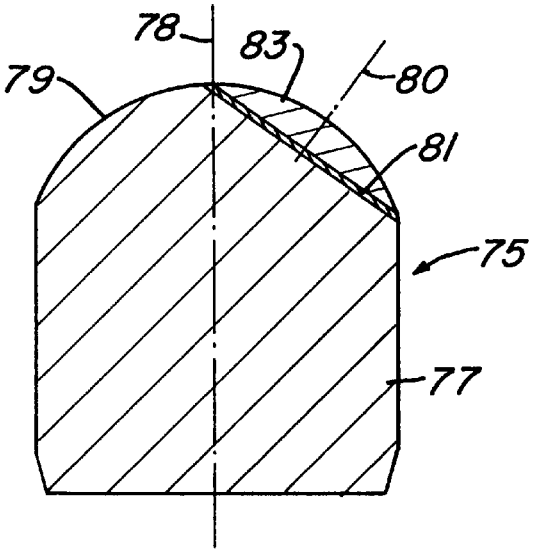
FIG. 6 is a sectional view of a second alternate embodiment of an insert constructed in accordance with this invention.
Figure 7:
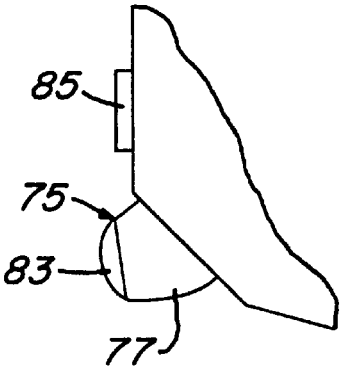
FIG. 7 is a schematic view of a portion of a cutter for an earth boring bit, illustrating the location of the insert of FIG. 6.

In a third embodiment shown in FIGS. 6 and 7, cutting element 75 has a body which includes a cylindrical base 77 and an ovoid cutting end 79. The flat contact surface 81, however, is skewed or inclined relative to the longitudinal axis 78 of base 77, unlike the second embodiment. Contact surface 81 has a central axis 80 which intersects axis 78 at a point within body 77. Tip 83 may be the same dimensions and material as in connection with the second embodiment. Tip 83 is brazed to contact surface 81, which places tip 83 on a side area of cutting end 79.

As shown in FIG. 7, cutting element 75 is located in a heel row adjacent to the gage surface which contains gage inserts 85. Cutting element 75 is oriented with tip 83 on an outer side to engage a side wall of a borehole. The outer side of heel row inserts is the area where maximum wear normally takes place.

The earth-boring bit according to the present invention has many advantages. The layer of diamond may be preformed and attached by brazing. This has advantages in allowing a variety of shapes and configurations. The cutting end may be self-sharpening in highly abrasive environments. The contact surface or interface, being parallel to the bottom is not overloaded. The layer of diamond may also be formed in an HTHP process.

While the invention has been shown in only two of its forms, it should be apparent to those skilled in the art that it is not so limited but is susceptible to various changes without departing from the scope of the invention.

I claim:

1. An earth-boring bit comprising:

a bit body;

a cantilevered bearing shaft depending from the bit body;

a cutter mounted for rotation on the bearing shaft;

a plurality of cutting elements secured within holes formed in the cutter, at least one of the cutting elements comprising:

a cutting element body of hard metal, the cutting element body having a longitudinal axis and a cylindrical base which is inserted in an interference fit within one of the holes, the cutting element body having a bottom on one end and a contact surface on an opposite end, the contact surface having a generally circular perimeter and being substantially flat;

a layer of super-hard material having a substantially flat contact end bonded to the contact surface, the layer having a rounded exposed convex end which defines a tip for the cutting element, the layer having a periphery which is tapered and fits flush with the cutting element body at the perimeter of the contact surface.

2. The earth-boring bit according to claim 1, wherein the convex end of the layer of super-hard material is conical.

3. The earth-boring bit according to claim 1, wherein the cutting element body has a conical portion extending from the cylindrical base, the conical portion being truncated by the contact surface, and wherein the convex end of the layer of super-hard material is conical.

4. The earth-boring bit according to claim 1, wherein the cutting element body has an ovoid portion extending from the cylindrical base, the ovoid portion being truncated by the contact surface, and wherein the convex end of the layer of super-hard material is ovoid-shaped.

5. The earth-boring bit according to claim 1, wherein the cutting element body has an ovoid portion extending from the cylindrical base, the ovoid portion being truncated by the contact surface, the contact surface being skewed relative to the longitudinal axis, and wherein the convex end of the layer of super-hard material is ovoid-shaped.

6. The earth-boring bit according to claim 1, wherein the contact surface is skewed relative to the longitudinal axis and the cutting element body is secured to the cutter so as to place the tip on an outer side of the cutting element body for engaging a sidewall of a borehole.

7. The earth-boring bit according to claim 1, wherein the layer of super-hard material comprises a preformed member attached by brazing to the contact surface.

8. The earth-boring bit according to claim 1, wherein the layer of super-hard material is a free-standing layer of diamond film formed by chemical vapor deposition that is brazed to the contact surface.

9. The earth-boring bit according to claim 1, wherein the layer of super-hard material is polycrystalline diamond formed on the contact surface by high pressure and high temperature.

10. An earth-boring bit comprising:

a bit body;

a cantilevered bearing shaft depending from the bit body;

a cutter mounted for rotation on the bearing shaft;

a plurality of cutting elements secured within holes formed in the cutter, at least one of the cutting elements comprising:

a cutting element body of hard metal, the cutting element body having a longitudinal axis and a cylindrical base with a bottom which is inserted in an interference fit within one of the holes;

the cutting element body having a convex cutting end which protrudes from the hole, the cutting end having side surfaces which are truncated to form a substantially flat contact surface, the contact surface having a peripheral border which forms an obtuse angle with the side surfaces; and a layer of super-hard material bonded to the contact surface, defining a tip for the cutting element, the layer having a convex cutting end and peripheral tapered edges which fit flush with the border and smoothly join the side surfaces.

11. The earth-boring bit according to claim 10, wherein the cutting element body has an ovoid portion extending from the cylindrical base, the ovoid portion being truncated by the contact surface, and wherein the convex end of the layer of super-hard material is ovoid-shaped.

12. The earth-boring bit according to claim 10, wherein the cutting element body has an ovoid portion extending from the cylindrical base, the ovoid portion being truncated by the contact surface, the contact surface being skewed relative to the longitudinal axis, and wherein the convex end of the layer of super-hard material is ovoid-shaped.

13. The earth-boring bit according to claim 10, wherein the contact surface is skewed relative to the longitudinal axis and the cutting element body is secured to the cutter so as to place the tip on an outer side of the cutting element body for engaging a sidewall of a borehole.

14. The earth-boring bit according to claim 10, wherein the contact surface is substantially parallel to the bottom of the base, wherein the base has an axis, and wherein an axial distance from the contact surface to an extreme end of the tip is smaller than an axial distance from a junction of the cutting end with the cylindrical base to the contact surface.

15. The earth-boring bit according to claim 10, wherein the layer of super-hard material is a free-standing layer of diamond film formed by chemical vapor deposition that is brazed to the contact surface.

16. The earth-boring bit according to claim 10, wherein the layer of super-hard material is polycrystalline diamond formed on the contact surface by high pressure and high temperature.

17. An earth-boring bit comprising:

a bit body;

a cantilevered bearing shaft depending from the bit body;

a cutter mounted for rotation on the bearing shaft;

a plurality of cutting elements secured within holes formed in the cutter, at least one of the cutting elements comprising:

a cutting element body of hard metal, the cutting element body having a longitudinal axis and a cylindrical base with a bottom which is inserted in an interference fit within one of the holes;

the cutting element body having a convex cutting end which protrudes from the hole, the cutting end having side surfaces which are truncated to form a contact surface, the contact surface having a peripheral border which forms an obtuse angle with the side surfaces;

a layer of super-hard material bonded to the contact surface, defining a tip for the cutting element, the layer having peripheral tapered edges which fit flush with the border and smoothly join the side surfaces; and wherein the side surfaces and the layer of super-hard material are conical.

18. An earth-boring bit comprising:

a bit body;

a cantilevered bearing shaft depending from the bit body;

a cutter mounted for rotation on the bearing shaft;

a plurality of cutting elements secured within holes formed in the cutter, at least one of the cutting elements comprising:

a cutting element body of hard metal, the cutting element body having a cylindrical base which is inserted in an interference fit within one of the holes, the cutting element body having a bottom on one end, a protruding cutting end which is in the shape of an ovoid and is truncated to form a contact surface, the contact surface having a peripheral border, the contact surface being skewed relative to a longitudinal axis of the body;

a layer of super-hard material bonded to the contact surface, defining a tip for the cutting element, the layer having an exposed convex end in the shape of an ovoid, the layer having peripheral tapered edges which fit flush with the border of the contact surface; and wherein the cutting element is oriented within one of the holes so as to position the tip on an outer side for engaging a sidewall of a borehole.

19. The earth-boring bit according to claim 18, wherein the layer of super-hard material is a free-standing layer of diamond film formed by chemical vapor deposition that is brazed to the contact surface.

20. The earth-boring bit according to claim 18, wherein the contact surface is substantially flat.

* * * * *